US007547375B2

(12) United States Patent
Jaffee et al.

(10) Patent No.: US 7,547,375 B2
(45) Date of Patent: Jun. 16, 2009

(54) METHOD OF MAKING TOUGH, FLEXIBLE MATS FOR COLLAPSABLE CEILING TILE

(75) Inventors: Alan Michael Jaffee, Bowling Green, OH (US); Richard Emil Kajander, Toledo, OH (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 11/820,353

(22) Filed: Jun. 19, 2007

(65) Prior Publication Data

US 2007/0264895 A1 Nov. 15, 2007

Related U.S. Application Data

(63) Continuation of application No. 10/717,802, filed on Nov. 20, 2003, now abandoned.

(51) Int. Cl.
*D21H 13/40* (2006.01)
*D21H 17/37* (2006.01)

(52) U.S. Cl. ..... 162/156; 162/159; 162/169; 428/921; 442/180

(58) Field of Classification Search ..... 162/145, 162/148, 149, 152, 156, 157.4, 158, 159, 162/166, 168.1, 169; 428/312.2, 921; 442/136, 442/180, 301, 414, 355, 331, 266, 267
See application file for complete search history.

(56) References Cited

U.S. PATENT DOCUMENTS

| | | | | |
|---|---|---|---|---|
| 4,076,917 | A | | 2/1978 | Swift et al. |
| 4,112,174 | A | | 9/1978 | Hannes et al. |
| 4,681,802 | A | | 7/1987 | Gaa et al. |
| 4,810,576 | A | | 3/1989 | Gaa et al. |
| 5,661,213 | A | | 8/1997 | Arkens et al. |
| 5,772,846 | A | * | 6/1998 | Jaffee ..... 162/145 |
| 5,837,620 | A | * | 11/1998 | Kajander ..... 442/63 |
| 5,840,413 | A | | 11/1998 | Kajander |
| 6,008,147 | A | | 12/1999 | Jaffee |
| 6,291,011 | B1 | | 9/2001 | Edlund |
| 6,331,350 | B1 | | 12/2001 | Taylor et al. |
| 2002/0020142 | A1 | | 2/2002 | Swiszcz et al. |
| 2003/0109190 | A1 | | 6/2003 | Geel |

FOREIGN PATENT DOCUMENTS

| | | | |
|---|---|---|---|
| EP | 0 378 295 | * | 1/1990 |
| EP | 0 990 728 | * | 4/2000 |

* cited by examiner

*Primary Examiner*—Eric Hug
(74) *Attorney, Agent, or Firm*—Robert D. Touslee

(57) ABSTRACT

Making mats using glass fibers having a diameter of about 13+/−3 microns, bound with a binder formed from a homopolymer or a copolymer of polyacrylic acid and a polyol produces fibrous nonwoven mats having high tensile strength and also an unexpected high flame resistance considering the amount of oxygen in the binder. Mats of the present invention pass the National Fire Protection Association's (NFPA) Flammability Test. Tabor stiffness of these mats is greater than about 40, preferably greater than about 50 and most preferably greater than about 55. Air permeability of the mats is preferably within the range of about 500 to about 800 CFM/sq. ft. Methods of making the mat are also disclosed.

26 Claims, No Drawings

METHOD OF MAKING TOUGH, FLEXIBLE MATS FOR COLLAPSABLE CEILING TILE

This application is a continuation of application Ser. No. 10/717,802, now abandoned, filed Nov. 20, 2003.

The present invention relates to a method of making a formaldehyde free, fibrous, nonwoven mats for use in facing ceiling panels and other applications where similar requirements exist, and these mats.

Ceiling panels are commonly used to form the ceiling of a building and can be made from a variety of materials including mineral fibers, cellulosic fibers, fiberglass, wood, metal and plastic. It is typically beneficial for such ceiling panels to have good structural properties such as stiffness and resiliency, as well as flame resistance characteristics. For some applications, it can also be beneficial for the ceiling panel to have acoustic absorption properties.

It would be advantageous to provide a ceiling panel that possesses excellent structural, flame resistance and acoustic absorption properties and in addition, very light weight. It would be even further advantageous, to aid shipping and storing costs, if the ceiling panels were able to be compressed to a fraction of their normal size for packaging, and then would spring back to normal size for installation and service. Such a ceiling panel has been designed by others utilizing fibrous, nonwoven mat, see published U.S. Patent Application No. 20020020142 filed Apr. 23, 2001. Unfortunately, conventional fibrous nonwoven mats have failed to meet all of the requirements and desires of this design, which are to be formaldehyde free and to be able to avoid giving off toxic gases when subjected to fire. Johns Manville's DURAGLAS™ 8802 mat, an acrylic bonded, wet laid, blend of glass fiber polyester, mat failed to perform satisfactorily in this ceiling tile because of excessive flammability and excessive sag at ambient temperatures. The present invention overcomes these problems and fills this need for a suitable mat for making ceiling tile according to the above-mentioned U.S. Published Patent Application.

The present invention comprises a method of making a formaldehyde free, fibrous, nonwoven mat. The method includes dispersing fibers having an average fiber diameter of 13+/−1.5 to 13+/−3 microns to produce an aqueous dispersion, the dispersion comprising glass fibers and man-made polymer fibers, draining much of the water from the dispersion through a moving permeable forming belt to form a wet fibrous web. The wet web is saturated with an aqueous resin binder and the excess binder is removed in a conventional manner to produce the desired binder content in the wet web. The aqueous binder is a mixture comprised of water and a resin formed from a homopolymer or a copolymer of polyacrylic acid and a polyol. The wet web is then heated to remove the water and to at least partially cure the resin in the binder to form a resin bounded fibrous non woven mat.

The preferred binder is called TSET® available from Rohm & Hass of Philadelphia, Pa. The binder content can vary up to about 35 wt. percent of the finished dry mat and down to about 10 wt. percent with contents in the range of about 15-25 wt. percent being preferred and 20+/−3 wt. percent being most preferred. Mats made by the method described above are also included in the present invention. An alternate source of a similar resin is BASF's Acronal 2348.

It has been discovered that the combination of using glass fibers having a diameter of about 13+/−3 micron, preferably 13+/−2, and most preferably 13+/−1.5 microns, bound with a binder formed from a homopolymer or a copolymer of polyacrylic acid and a polyol produces a fibrous nonwoven mat having high tensile strength, adequate smoothness and also an unexpected high flame resistance considering the amount of oxygen in the binder. Mats of the present invention pass the National Fire Protection Association's (NFPA) Method #701 Flammability Test. Tabor stiffness of these mats is greater than about 40, preferably greater than about 50 and most preferably greater than about 55. Air permeability of the mats is preferably within the range of about 500 to about 800 CFM/sq. ft. When "substantially free of phenol and urea formaldehyde" is used herein what is meant is that the content of phenol formaldehyde and urea formaldehyde and any formaldehyde compound is so low that the mat will pass the NFPA Flammability Test.

The mats of the invention, or binder used to bond the mat together, can also contain a small, but effective amount of one or more, fillers, pigments, biocide, fungicide, and water repellant of which there are many known compounds and commercially available products, either throughout the mat or concentrated on one or both surfaces. For example, the mat can contain effective amounts of fine particles of limestone, glass, clay, coloring pigments, biocide, fungicide, intumescent, or mixtures thereof. Preferably, the mats of the present invention have a cellulosic fiber content of zero or very low, usually being present only as an impurity of other ingredients.

When the word "about" is used herein it is meant that the amount or condition it modifies can vary some beyond that so long as the advantages of the invention are realized. Practically, there is rarely the time or resources available to very precisely determine the limits of all the parameters of ones invention because to do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

The inventive mat can be used as an exposed face on ceiling panels and as a facer or substrate for other products requiring good strength, good flammability resistance and free of formaldehyde. These mats contain about 65 to about 90 wt. percent fibers and about 10 to about 35 wt. percent binder.

The glass fibers are preferably about 0.75 inch long and have a fiber diameter of about 13+/−3 microns, preferably E glass fibers having a chemical sizing thereon as is well known. Fiber products preferred for use in the present invention are 0.75 inch K117 and K137 Wet Chop Fiber, products available from Johns Manville Corporation of Denver, Colo., but any type of glass fiber can be used that are normally used or suitable for the wet laid processes. Any type of stable glass fibers can be used, such as A, C, S, R, and E and other types of glass fibers. Preferably the average fiber diameter of glass fibers will range from about 10 to about 16 microns with fiber length ranging from about 0.25 to about 1.25 inches, preferably from about 0.5 to about 1 inch and most preferably about 0.7+/−0.15 inch.

The fibers are bound together by use of an aqueous binder composition applied with a curtain coater, dip and squeeze, roller coat, or other known saturating method in a known manner and the resultant saturated wet bindered web laying on a supporting wire or screen is run over one or more vacuum boxes to remove enough binder to achieve the desired binder content in the mat. The binder level in the inventive mats can range from about 10 to about 35 wt. percent of the finished dry mat, preferably about 15 to about 25 wt. percent and most preferably about 20+/−4 wt. percent to about 30 wt. The binder composition is curable by the application of heat, i.e., the binder composition is a thermosetting composition.

The binder composition includes a homopolymer or copolymer of polyacrylic acid. Preferably, the average molecular weight of the polyacrylic acid polymer is less than 10,000, more preferably less than 5,000, and most preferably about 3,000 or less, with about 2000 being preferred. Use of a low molecular weight polyacrylic acid polymer in a low-pH binder composition can result in a final product that exhibits excellent structural recovery and rigidity characteristics. The binder composition can also include at least one additional polycarboxy polymer such as, for example, a polycarboxy polymer disclosed in U.S. Pat. No. 6,331,350, the entire contents of which are incorporated by reference herein.

The binder composition also includes a polyol containing at least two hydroxyl groups. The polyol is preferably sufficiently nonvolatile such that it can substantially remain available for reaction with the polyacid in the composition during the heating and curing thereof. The polyol can be a compound with a molecular weight less than about 1,000 bearing at least two hydroxyl groups such as, for example, ethylene glycol, glycerol, pentaerythritol, trimethylol propane, sorbitol, sucrose, glucose, resorcinol, catechol, pyrogallol, glycollated ureas, 1,4-cyclohexane diol, diethanolamine, triethanolamine, and certain reactive polyols such as, for example, -hydroxyalkylamides such as, for example, bis[N,N-di(-hydroxyethyl)]adipamide, as can be prepared according to U.S. Pat. Nos. 6,331,350 and 4,076,917, incorporated herein by reference, the contents of which are incorporated by reference herein. The polyol can be an addition polymer containing at least two hydroxyl groups such as, for example, polyvinyl alcohol, partially hydrolyzed polyvinyl acetate and homopolymers or copolymers of hydroxyethyl (meth) acrylate, hydroxypropyl (meth) acrylate and the like. Most preferably, the polyol is triethanolamine (TEA).

The ratio of the number of equivalents of carboxy, anhydride, or salts thereof of the polyacid to the number of equivalents of hydroxyl in the polyol can be about 1/0.01 to about 1/3. Preferably, there is an excess of equivalents of carboxy, anhydride, or salts thereof of the polyacid to the equivalents of hydroxyl in the polyol of, for example, from about 1/0.4 to about 1/1, more preferably from about 1/0.6 to about 1/0.8, and most preferably from about 1/0.65 to about 1/0.75. A low ratio, for example, about 0.7:1, is preferred when combined with a low molecular weight polycarboxy polymer and a low pH binder.

The binder composition can also include a catalyst. Preferably, the catalyst is a phosphorus-containing accelerator that can be a compound with a molecular weight less than about 1000. For example, the catalyst can include an alkali metal polyphosphate, an alkali metal dihydrogen phosphate, a polyphosphoric acid, an alkyl phosphinic acid and mixtures thereof.

Additionally or alternatively, the catalyst can include an oligomer or polymer bearing phosphorous-containing groups such as, for example, addition polymers of acrylic and/or maleic acids formed in the presence of sodium hypophosphite, addition polymers prepared from ethylenically unsaturated monomers in the presence of phosphorous salt chain transfer agents or terminators, addition polymers containing acid-functional monomer residues such as, for example, copolymerized phosphoethyl methacrylate, and like phosphonic acid esters, and copolymerized vinyl sulfonic acid monomers, and their salts, and mixtures thereof.

The catalyst can be used in an amount of from about 1% to about 40%, by weight based on the combined weight of the polyacrylic acid polymer and the polyol. Preferably, the catalyst is used in an amount of from about 2.5% to about 10%, by weight based on the combined weight of the polyacrylic acid polymer and the polyol.

The binder composition can also contain treatment components such as, for example, emulsifiers, pigments, fillers, anti-migration aids, curing agents, coalescents, wetting agents, biocides, plasticizers, organosilanes, anti-foaming agents, colorants, waxes and anti-oxidants. The binder composition can be prepared by mixing together a polyacrylic acid polymer and a polyol. Mixing techniques known in the art can be used to accomplish such mixing.

Preferably, the pH of the binder composition is low, for example, about 3 or less, preferably about 2.5 or less, and most preferably about 2 or less. The pH of the binder can be adjusted by adding a suitable acid, such as sulfuric acid. Such low pH of the binder can provide processing advantages, while also providing a product that exhibits excellent recovery and rigidity properties. Examples of the processing advantages include a reduction in cure temperature or time. The reduction in cure temperature can result in a reduction of the amount of energy needed to cure the binder, and thereby can permit, if desired, the use of more water in the binder to obtain processing benefits.

To increase the flame resistance of the ceiling panel, a flame retardant material can be employed. The flame retardant material can be incorporated into the ceiling panel by, for example, mixing it into the aqueous binder. Any flame retardant material that is suitable for use in a fibrous mat can be used including, for example, an organic phosphonate. Such an organic phosphonate is available from Rhodia located in Cranbury, N.J., under the tradename Antiblaze NT.

Preferably, a dilute aqueous slurry of the glass fibers can be formed and deposited onto an inclined moving screen forming wire to dewater the slurry and form a wet nonwoven fibrous mat. For example, a Hydroformer available from Voith-Sulzer located in Appleton, Wis., or a Deltaformer available from Valmet/Sandy Hill located in Glenns Falls, N.Y., can be used. Other similar wet mat machines can also be used.

After forming the wet, uncured web, it is preferably transferred to a second moving screen running through a binder application station where the aqueous binder described above is applied to the mat. The binder can be applied to the structure by any suitable means including, for example, air or airless spraying, padding, saturating, roll coating, curtain coating, beater deposition, coagulation or dip and squeeze application. A curtain coater is preferred.

The excess binder, if present, is removed to produce the desired binder level in the mat. The web is formed and the binder level controlled to produce a binder content in the finished dry mat as described above and to produce a dry mat product having a basis weight of between about 1 lb./100 sq. ft. to about 3 lbs./100 sq. ft., preferably from about 2 lbs./100 sq. ft. to about 2.75 lbs./100 sq. ft. such as about 2.5+/−0.2 lbs./100 sq. ft. The wet mat is then preferably transferred to a moving oven belt which transports the wet mat through a drying and curing oven such as, for example, a through air, air float or air impingement oven. Prior to curing, the wet mat can be optionally slightly compressed, if desired, to give the finished product a predetermined thickness and surface finish.

In the oven, the bindered web can be heated to effect drying and/or curing forming a dry mat bonded with a cured binder. For example, heated air can be passed through the mat to remove the water and cure the binder. For example, the heat treatment can be around 400 F. or higher, but preferably the mat is at or near the hot air temperature for only a few seconds in the downstream end portion of the oven. The duration of the heat treatment can be any suitable period of time such as, for example, from about 3 seconds to 5 minutes or more, but normally takes less than 3 minutes, preferably less than 2 minutes and most preferably less than 1 minute. It is within the ordinary skill of the art, given this disclosure, to vary the curing conditions to optimize or modify the mat to have the desired properties.

The drying and curing functions can be conducted in two or more distinct steps. For example, the binder composition can be first heated at a temperature and for a time sufficient to substantially dry but not to substantially cure the composition and then heated for a second time at a higher temperature and/or for a longer period of time to effect curing. Such a procedure, referred to as "B-staging," can be used to provide binder-treated nonwoven, for example, in roll form, which can at a later stage be cured, with or without forming or molding into a particular configuration, concurrent with the curing process.

The following examples are provided for illustrative purposes and are in no way intended to limit the scope of the present invention.

EXAMPLE 1

Fibers were dispersed in a conventional white water in a known manner to produce a slurry in which the fibers were 1" long E glass fibers having an average fiber diameter of about 16 microns. A wet web was formed from the slurry in a conventional manner using a Voith Hydroformer®. Thereafter, the wet web was saturated with a conventional modified urea formaldehyde resin binder composition using a curtain coater and excess aqueous binder was removed to produce a binder content in the finished mat of about 25%, based on the weight of the finished dry mat. The bindered mat was then subjected to a heat treatment at a peak temperature of about 400 degrees F. for about to dry the mat and cure the binder. This mat had a basis weight of about 2 lbs./100 sq. ft. and the following properties:

Thickness—40 mils

Tensile Strength—Machine Direction (MD)—105 lbs./3 in. width

Cross-machine Direction (CMD)—75 lbs./3 in. width

This mat represents a typical prior art mat. This mat is undesirable with ceiling panel manufacturers because of the roughness of the surface and the presence of formaldehyde in the binder which can encounter some formaldehyde emissions in high temperature, high humidity conditions.

EXAMPLE 2

A mat was made in the same manner as in Example 1 except the modified urea formaldehyde binder was replaced with TSET™ binder, an aqueous polyacrylic acid/polyol resin binder available from Rohm and Haas of Philadelphia, Pa. The mat had a basis wt. of 2.47 lbs./100 sq. ft. and the following other physical properties:

Average thickness—54 mils

MD+CMD Tensile—242 lbs./3 in. width

Taber stiffness—72.5

This mat did not perform satisfactorily as a facer or a backer on the ceiling panel disclosed in U.S. Published Patent Application No. 20020020142 because the exposed surface was too rough and unacceptable visually.

EXAMPLE 3

Fibers having an average fiber diameter of about 13 microns and a length of 0.75 inch, commercial fiber product called K137 available from Johns Manville Corporation of Denver, Colo., were dispersed in the same conventional white water used in Example 1 in the same manner to produce a slurry. Several wet webs of different basis weights were formed from the slurry using a Voith Hydroformer®. Thereafter, the wet webs were saturated with TSET™ binder, an aqueous polyacrylic acid/polyol resin binder composition, using a curtain coater. Excess binder was removed in a conventional manner to produce different binder contents in the finished mats in the range of about 15+/− about 3 weight percent, based on the weight of the finished dry mat. The bindered mats were then subjected to a heat treatment at a peak temperature of 170 degrees C. for 5-15 seconds to dry the mat and cure the binder. This mat had a basis weight of about 2.3-2.6 lbs./100 sq. ft. and the following other properties:

Thickness—47+/−5 mil

Tensile Strength Machine Direction—90+lbs./3 in. width

Cross-machine Direction—60+lbs./3 in. width

MD tensile/CMD tensile, squareness—1.2-1.8

Air Permeability—500-700 CFM/sq. ft.

This mat performed satisfactorily as the exposed mat and the backer mat in the manufacture of ceiling panels made according to U.S. Published Patent Application No. 20020020142. When used as the exposed facer, it hid the webs in this panel. This mat also performed satisfactorily as a facer for a conventional fiber glass wool ceiling panel.

EXAMPLE 4

The same kind of fibers as used in Example 3 were dispersed in a conventional white water in a known manner to produce a slurry. A wet web was formed from the slurry using a Voith Hydroformer®. Thereafter, the wet web was saturated with TSET™, an aqueous polyacrylic acid/polyol resin binder composition, using a curtain coater and excess aqueous binder was removed to produce a binder content in the finished mat of about 16.5%, based on the weight of the finished dry mat. The bindered mat was then subjected to a heat treatment at a peak temperature of about 400 degrees F. for about 3 seconds to dry the mat and cure the binder. This mat had a basis weight of about 2.38 lbs./100 sq. ft. and the following properties:

Thickness—44 mils

MD+CMD tensile strength—238 lbs./3 in. width

Taber Stiffness—52

Permeability—588 CFM/sq. ft.

This mat performed satisfactorily as the facer mat and as the backer mat in the manufacture of ceiling panels made according to U.S. Published Patent Application No. 20020020142. This mat also performed satisfactorily as a facer for a conventional fiber glass wool ceiling panel and is useful as a facer for other types of conventional ceiling panels.

The mats of the present invention also have unexpectedly high flame resistance in view of the oxygen content of the binder used in these mats. These mats pass the flammability test of NFPA, Method #701.

By modifying the above method in the drying/curing step, a mat with different characteristics is produced. The modification is to drop the temperature in the oven such that the binder in the mat is cured to only a "B" stage condition. This can be achieved by heating the mat to only about 250 degrees F. in the oven. The time at lower maximum temperature can be varied, but typical time is about 30 seconds or less. Mats made with this modification can be thermoformed to a desired shape, or pleated and then heated to complete the cure of the binder. The desired shape will then be retained in the mat. Such molded shapes can have many uses such as performs for SRIM and laminating processes, pleated filters and many other uses.

The above inventive mats can also be coated on-line or off-line in the manner disclosed in U.S. Pat. No. 6,291,011, to produce facer mats having a desired pattern. The coating could be done before applying to the ceiling panel or after the mat is part of the ceiling panel, or the hydrophilic coating could be applied to selected areas of the mat before the mat is applied to a ceiling panel and the final coating applied after the facer is applied to the ceiling panel.

While the invention has been described with preferred embodiments, it is to be understood that variations and modifications can be resorted to as will be apparent to those skilled in the art. Just for the purposes of illustration of variations included in the present invention, carbon black can be incorporated into the binder to affect color as can titania, limestone, or kaolin clay particles if a white mat is desired or color pigment if a colored mat is desired. Some whitening agents that are particularly effective are NovaCote™, a pigmented white base coating available from Georgia-Pacific of Atlanta, Ga., SUPER SEATONE® Titanium White available from Noveon of Cincinnati, Ohio, ROPAQUE® polymer latexes for paper coating available from Rohm and Haas and Polyplate™ P, a delaminated kaolin clay available from J.M. Huber Corporation of Macon, Ga. Also, fire retardants can be incorporated into the aqueous binder composition, such as organic phosphates like ANTI-BLAZE™ NT from Rhodia of Cranburry, N.J. and other functional or filler additives as mentioned above. Such variations and modifications are to be considered within the purview and the scope of the claims appended hereto.

The invention claimed is:

1. A method for making a fibrous nonwoven mat facer suitable as a backer mat, connector sheet, in a compressible ceiling panel of the type described in U.S. Published Patent Application No. 200200020142, filed Apr. 23, 2001, comprising;

a) dispersing glass fibers having an average fiber diameter of 13+/−1.5 microns and a length of about 0.75+/−0.15 inch in an aqueous dispersion, b) draining said dispersion through a moving forming screen to form a wet fibrous web, c) applying an aqueous resin binder to the wet web and removing excess binder to produce a binder content in the web, after drying, in the range of about 15+/−3 wt. percent, the aqueous binder comprising a mixture of water and a resin formed from a homopolymer or a copolymer of polyacrylic acid and a polyol, the average molecular weight of the homopolymer or a copolymer of polyacrylic acid being less than about 5000 and the aqueous binder having a pH of less than about 2.5 controlling steps b and c to produce a wet mat, that when dry, has a basis wt. of 2.5+/−0.2 pounds per 100 sq. feet and a thickness in the range of 47+/−5 mils; and d) drying the wet web and at least partially curing the resin in the binder to form an essentially formaldehyde free resin bound fibrous non woven mat containing glass fibers in amounts of about 65 to about 90 wt. percent that;

passes the flammability test of NFPA, Method #701, has a Taber stiffness of greater than about 50, and has an air permeability in the range of about 500 to about 800 CFM/sq. ft.

2. The method according to claim 1 wherein the binder is substantially free of phenol, formaldehyde and urea.

3. The method according to claim 1 wherein the average molecular weight of the polyacrylic acid polymer is about 3,000 or less.

4. The method according to claim 1 wherein the polyol is triethanolamine.

5. The method of claim 1 wherein the mat also contains an effective amount of an organic phosphonate to further increase flame resistance.

6. A method of making a nonwoven fibrous mat suitable as a backer mat, connector sheet, in a compressible ceiling panel of the type described in U.S. Published Patent Application No. 200200020142, filed Apr. 23, 2001, the mat comprising about 90 to about 65 wt. percent glass fibers bound together with about 15+/−3 wt. percent of a binder that is essentially free of formaldehyde, phenol and urea, that is at least partially cured and that comprises before drying and curing a homopolymer or a copolymer of polyacrylic acid and a polyol, the mat having a basis weight in the range of 2.3 to 2.6 pounds per 100 square feet, and a thickness in the range of 47+/−5 mils, the method comprising a) forming an aqueous suspension containing glass fibers, the fibers having a fiber diameter of 13+/−1.5 microns and a length in the range of about 0.75+/−0.15 inch, b) passing the aqueous fiber suspension through a moving permeable screen to form a wet fibrous web, c) applying an aqueous binder that is essentially free of formaldehyde, phenol and urea, that is at least partially cured and comprises before drying and curing a homopolymer or a copolymer of polyacrylic add and a polyol, the average molecular weight of the polyacrylic acid homopolymer or copolymer being about 3,000 or less and the pH of the aqueous binder being less than about 2, and removing any excess aqueous binder to achieve the above stated binder content, and d) drying and at least partially curing the binder in the mat to produce, the nonwoven fibrous mat having the properties of passing the flammability test of NFPA, Method #701, having a Taber stiffness of greater than about 50, having a combined machine direction plus cross machine direction tensile strength of at least about 1500 lbs. Per 3 inch wide strip and having an air permeability in the range of about 500 to about 800 CFM/sq. ft.

7. The method according to claim 6 wherein the average molecular weight of the polyacrylic acid polymer is about 2,000.

8. The method according to claim 6 wherein the polyol is triethanolamine.

9. The method of claim 6 wherein the mat also contains an effective amount of an organic phosphonate to further increase flame resistance.

10. The method according to claim 6 wherein the binder further comprises a one or more additives selected from the group consisting of pigments, fillers, fire retardants, biocides, anti-fungal agents and catalysts, such as a phosphorus-containing catalyst, and mixtures thereof.

11. The method of claim 6 wherein at least portions of a surface of the wet, bindered web is coated with an aqueous hydrophilic mixture prior to drying.

12. A method of making a nonwoven fibrous mat suitable as a backer mat, connector sheet, in a compressible ceiling panel of the type described in U.S. Published Patent Application No. 200200020142, filed Apr. 23, 2001, the mat comprising about 85+−3 wt. percent glass fibers bound together with about 15+/−3 wt. percent of a binder that is essentially free of formaldehyde, phenol and urea, that is at least partially cured and that comprises before drying and curing a homopolymer or a copolymer of polyacrylic acid and a polyol, the mat having a basis weight in the range of 2.3 to 2.6 pounds per 100 square feet, and a thickness in the range of 47+/−5 mils; the method comprising a) forming an aqueous suspension containing glass fibers, the fibers having a fiber diameter of 13+/−1.5 microns and a length in the range of about 0.55 to about 0.85 inch, b) passing the aqueous fiber suspension through a moving permeable screen to form a wet fibrous web, a) applying an aqueous binder having a pH of less than about 2 and that is essentially free of formaldehyde, phenol and urea, that is at least partially cured and comprises before drying and curing a homopolymer or a copolymer of polyacrylic acid and a polyol, the average molecular weight of the polyacrylic acid homopolymer or copolymer being about 3,000 or less and removing any excess aqueous binder to achieve the above stated binder content, and d) drying and at least partially curing the binder in the mat to produce, the nonwoven fibrous mat having the properties of passing the flammability test of NFPA, Method #701, having a Taber stiffness of greater than about 50, and having an air permeability in the range of about 500 to about 700 CFM/sq. ft.

13. The method according to claim 12 wherein the average molecular weight of the polyacrylic acid polymer is about 2,000.

14. The method according to claim 12 wherein the polyol is triethanolamine.

15. The method of claim 12 wherein the mat also contains an effective amount of an organic phosphoriate to further increase flame resistance.

16. The method according to claim 12 wherein the binder further comprises a one or more additives selected from the group consisting of pigments, fillers, fire retardants, biocides, anti-fungal agents and catalysts, such as a phosphorus-containing catalyst, and mixtures thereof.

17. The method of claim 12 wherein at least portions of a surface of the dry mat is coated with a hydrophilic mixture followed by further drying.

18. The method of claim 12 wherein the mat has a thickness of about 47+/−5 mils and a combined machine direction tensile strength and cross machine direction tensile strength greater than about 150 pounds per 3 in. width.

19. The method of claim 13 wherein the mat has a thickness of about 47+/−5 mils and a combined machine direction tensile strength and cross machine direction tensile strength greater than about 150 pounds per 3 in width.

20. The method of claim 14 wherein the mat has a thickness of about 47+/−5 mils and a combined machine direction tensile strength and cress machine direction tensile strength greater than about 150 pounds per 3 in. width.

21. The method of claim 15 wherein the mat has a thickness of about 47+/−5 mils and a combined machine direction tensile strength and cross machine direction tensile strength greater than about 150 pounds per 3 in. width.

22. The method of claim 16 wherein the mat has a thickness of about 47+/−5 mils and a combined machine direction tensile strength and cross machine direction tensile strength greater than about 150 pounds per 3in. width.

23. The method of claim 12 wherein the binder content is about 16.5 wt. percent and the Taber stiffness is at least about 52.

24. The method of claim 19 wherein the binder content is about 16.5 wt. percent and the Taber stiffness is at least about 52.

25. The method of claim 20 wherein the binder content is about 16.5 wt. percent and the Taber stiffness is at least about 52.

26. The method of claim 21 wherein the binder content is about 16.5 wt. percent and the Taber stiffness is at least about 52, and the binder further comprises a one or more additives selected from the group consisting of pigments, fillers, fire retardants, biocides, anti-fungal agents and catalysts, such as a phosphorus-containing catalyst, and mixtures thereof.

* * * * *